US007165676B2

(12) United States Patent
Dalessandro

(10) Patent No.: US 7,165,676 B2
(45) Date of Patent: Jan. 23, 2007

(54) HEAT SEAL BLISTER PACKAGE HAVING IMPROVED MOISTURE VAPOR TRANSMISSION BARRIER AND METHOD FOR FORMING SAME

(75) Inventor: Anna Dalessandro, St. Charles, IL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 0 days.

(21) Appl. No.: 10/125,909

(22) Filed: Apr. 19, 2002

(65) Prior Publication Data

US 2003/0196925 A1 Oct. 23, 2003

(51) Int. Cl.
*B65D 73/00* (2006.01)

(52) U.S. Cl. ..... 206/461; 206/524.3

(58) Field of Classification Search ..... 156/322; 206/461–465, 467–471, 531, 532, 534, 538, 206/539, 540, 784, 524.3; 426/107; 428/34.2, 428/40.6, 518; 526/256
See application file for complete search history.

(56) References Cited

U.S. PATENT DOCUMENTS 3,449,302 A * 6/1969 Nachbur et al. ..... 526/256
3,645,824 A * 2/1972 Patton ..... 156/322
3,716,511 A * 2/1973 Haskell ..... 524/99
3,784,004 A * 1/1974 Meyer ..... 206/471
3,850,726 A * 11/1974 Smith et al. ..... 428/518
3,872,970 A * 3/1975 Edison ..... 206/532
3,946,139 A * 3/1976 Bleyle et al. ..... 428/518
4,125,190 A 11/1978 Davie, Jr. et al.
4,266,666 A 5/1981 Kuchenbecker
4,270,659 A 6/1981 Kuchenbecker
4,359,158 A 11/1982 Gringer
4,574,951 A * 3/1986 Weaver ..... 206/461
4,702,368 A * 10/1987 Jones ..... 206/45.24
4,901,858 A 2/1990 Anderson
4,925,684 A * 5/1990 Simon ..... 426/107
5,150,793 A 9/1992 Tannenbaum
5,172,812 A 12/1992 Wharton et al.
5,244,087 A * 9/1993 Hikake et al. ..... 206/701
5,244,996 A * 9/1993 Kawasaki et al. ..... 526/347
5,353,935 A 10/1994 Yeager et al.
5,356,010 A 10/1994 Weinstein
5,360,116 A 11/1994 Schmiletzky
5,377,836 A 1/1995 Eisenbraum
5,414,008 A * 5/1995 Muller et al. ..... 514/381
5,418,008 A * 5/1995 Calvert ..... 427/203
5,486,390 A * 1/1996 Burns et al. ..... 428/40.6

(Continued)

*Primary Examiner*—Mickey Yu
*Assistant Examiner*—Jerrold Johnson
(74) *Attorney, Agent, or Firm*—Armstrong Teasdale LLP

(57) ABSTRACT

A heat seal blister package having an improved moisture vapor transmission barrier hindering penetration of moisture into the blister package from the surrounding environment to support and protect a product therewithin, and a method for forming same. The blister package includes a substantially paperboard substrate, a coating having moisture vapor transmission barrier properties and heat seal capabilities and a plastic blister attached to at least one side of the substrate over a coated portion of the substrate by a heat seal, to create an enclosed pocket isolated from the surrounding environment, in which to house a product. The coating imparts a moisture vapor transmission barrier to the paperboard substrate to reduce penetration of moisture through the substrate, while simultaneously imparting heat sealing capabilities to the coated portion of the substrate to make the coated portion of the substrate susceptible to a heat seal.

25 Claims, 2 Drawing Sheets

U.S. PATENT DOCUMENTS 5,725,917 A * 3/1998 Parks ..... 428/34.2
5,775,516 A 7/1998 McCumber et al.
5,819,939 A 10/1998 Boyer
5,888,565 A * 3/1999 Gics ..... 426/124
5,935,664 A * 8/1999 Claytor et al. ..... 428/34.2
6,010,784 A 1/2000 Peterson
6,016,914 A 1/2000 Gustafson
6,053,320 A * 4/2000 Kuethe ..... 206/462
6,092,664 A * 7/2000 Bartosek ..... 206/784
6,155,423 A 12/2000 Katzner et al.
6,161,699 A 12/2000 Gartland
6,273,260 B1 * 8/2001 ColDepietro et al. ..... 206/532
6,365,680 B1 * 4/2002 Edgington et al. ..... 525/450
6,401,926 B1 6/2002 Lo
6,409,020 B1 6/2002 Lo
6,523,691 B2 * 2/2003 Raj et al. ..... 206/538
6,669,236 B1 12/2003 Hollwarth-Oberholz

* cited by examiner

FIG. 1
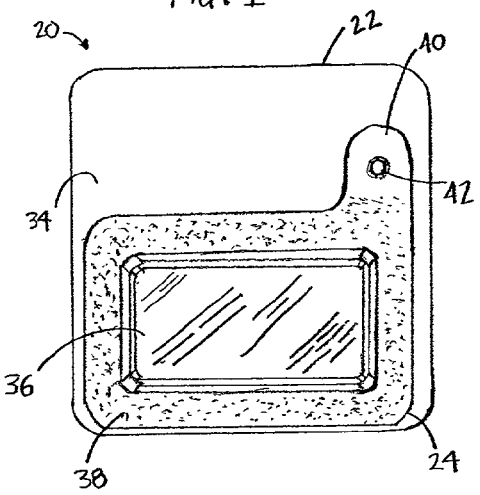
FIG. 2
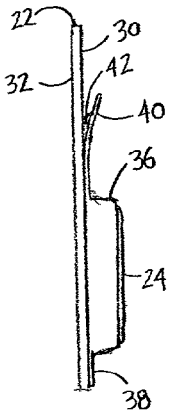
FIG. 3
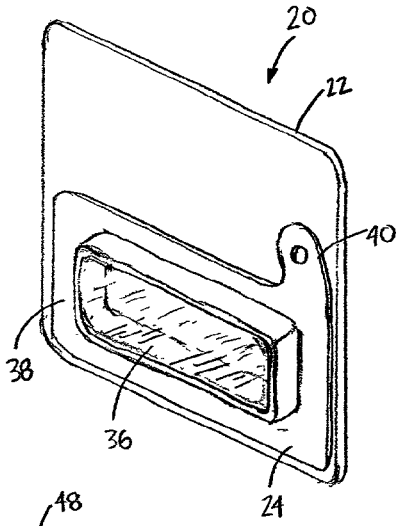
FIG. 4
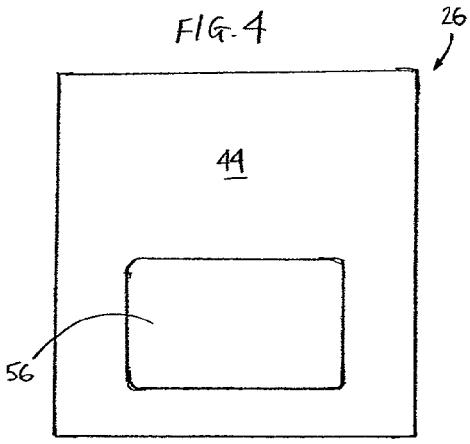
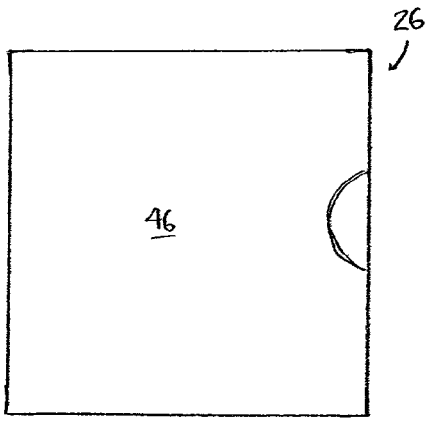
FIG. 5
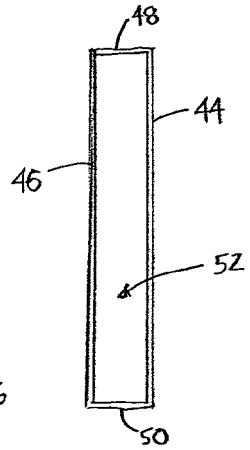
FIG. 6
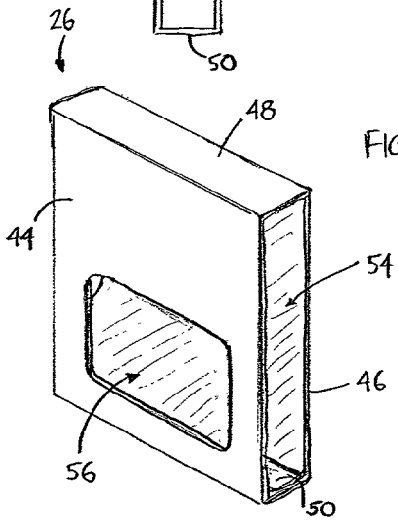
FIG. 7

HEAT SEAL BLISTER PACKAGE HAVING IMPROVED MOISTURE VAPOR TRANSMISSION BARRIER AND METHOD FOR FORMING SAME

BACKGROUND OF THE INVENTION

1. Field of the Invention

The present invention relates in general to a heat seal blister package for housing a product and, more particularly, to a heat seal blister package having improved moisture vapor transmission properties to house a product which is moisture sensitive.

2. Background Art

Blister cards and blister packages have been known in the art for many years. Typically, a clear plastic blister made of PVC or other similar material is adhered to a paperboard card or backing panel to form an enclosed pocket to house a product therein. The plastic blister provides an airtight seal to protect the product, while allowing a potential consumer to view the product through the clear plastic blister. The paperboard card or backing panel typically provides an opportunity for labeling, identifying or advertising the product.

It has been a common practice in the art to attach the plastic blister to the backing card via a heat seal. In particular, heat seal coatings, such as polyurethane-based coatings, are typically used to coat one side of the backing card. The heat seal polyurethane coatings are typically applied to the backing card in an off-set printing process. Upon coating the backing card, the plastic blister is then applied to the card with heat to bond the plastic blister to the underlying backing card.

Although these and other prior art heat seal blister packages employing a heat activated sealing coat, including those polyurethane-based heat seal coats, have worked well for the packaging of a wide variety of articles, conventional heat seal coatings can often provide little or no barrier to prevent or impede the transmission of moisture vapor from the surrounding environment through the paperboard backing card and into the enclosed pocket where the product is typically housed. While the plastic blister usually forms an impermeable barrier to moisture transmission, moisture from the surrounding environment can often penetrate through the paperboard backing card.

Thus, although moisture vapor transmission barrier properties may be unimportant for the housing of certain products in blister packages, such as inedible ones, or products not affected by exposure to humidity, etc., other products are moisture sensitive. For instance, moisture vapor penetration into the blister package may be particularly troublesome in the context of edible products, which can be highly moisture sensitive. For these and other types of moisture-sensitive products, the penetration of moisture vapor through the paperboard backing card can lead to degradation or destruction of the product contained within the blister package.

Moreover, coatings which possess moisture vapor transmission barrier properties are also known. In particular, these coatings have been employed in paperboard products to prevent moisture infiltration into various moisture sensitive products. For example, coatings having moisture vapor barrier properties have been used to coat detergent boxes, as moisture vapor penetration into powder detergent has been known to cause clumping or other degradation of the detergent. However, these moisture vapor transmission barrier coatings are not known to have been used in a context of heat sealing plastic to paperboard—particularly in the environment of forming a blister package.

Accordingly, it is desirable to provide a blister package in which the coating applied to the paperboard card or backing panel possesses not only the capability of forming a heat seal bond with a plastic blister, but also the moisture vapor transmission barrier properties to hinder penetration of moisture vapor through the backing card and into the interior of the blister package.

It is likewise desirable to provide a process for forming a heat seal blister package having improved moisture vapor transmission barrier properties. As part of this process, it is desirable to employ a rotogravure process for application of the heat seal coating, to closely control the weight range of the coating as applied to the paperboard backing card.

SUMMARY OF THE INVENTION

The present invention is directed to a heat seal blister package having an improved moisture vapor transmission barrier hindering penetration of moisture into the blister package from the surrounding environment to support and protect a product therewithin. The blister package includes a substantially paperboard substrate having a first side and a second side, a coating having moisture vapor transmission barrier properties and heat seal capabilities, and at least one plastic blister attached to the substantially paperboard substrate over a coated portion of the substantially paperboard substrate to create an enclosed pocket isolated from the surrounding environment in which to house a product. The plastic blister is preferably attached to the substantially paperboard substrate by a heat seal. The product is maintained in position between the blister and the substantially paperboard substrate, until the pocket is opened.

Preferably, the coating is applied to at least a portion of at least one of the first and second sides of the substantially paperboard substrate to, in turn, impart a moisture vapor transmission barrier to the substantially paperboard substrate to reduce transmission of moisture through the substantially paperboard substrate, while simultaneously imparting heat sealing capabilities to the coated portion of the substantially paperboard substrate to make the coated portion of the substantially paperboard substrate susceptible to a heat seal.

In one embodiment, the coating includes a vinylidene chloride polymer component. The coating preferably includes at least component selected from the group consisting of a vinylidene chloride polymer, a vinylidene dichloride polymer and a vinylidene chloride/vinylidene dichloride copolymer emulsion. In this embodiment, the coating may be predominant in a vinylidene chloride polymer selected from the same group consisting of a vinylidene chloride polymer, a vinylidene dichloride polymer and a vinylidene chloride/vinylidene dichloride copolymer emulsion.

In another embodiment, the coating further includes a wax component. In one particular embodiment, the coating includes approximately 95% by weight of a component selected from the group consisting of a vinylidene chloride polymer, a vinylidene dichloride polymer and a vinylidene chloride/vinylidene dichloride copolymer emulsion and approximately 5% by weight of a wax component.

In one particular embodiment, the coating includes approximately 80%–95% by weight of a vinylidene chloride/vinylidene dichloride copolymer emulsion and approximately 3%–10% by weight of wax component. In still another particular embodiment, the coating includes approximately 82.5%–87.5% by weight of a polyvinylidene dichloride/polyvinylidene chloride copolymer emulsion, approximately 3.0%–7.0% by weight paraffinic wax, approximately 5.0%–7.0% isopropyl alcohol and approximately 0.5%–1.0% by weight of a carboxylated amine.

The coating preferably has a weight ratio, as applied to the substantially paperboard substrate, ranging from approximately 0.75 lbs. dry weight coating/msf of the substantially paperboard substrate to approximately 1 lb. dry weight coating/msf of the substantially paperboard substrate. Once formed, the heat seal created between the plastic blister and the substantially paperboard substrate may be broken primarily by tearing fibers in the substantially paperboard substrate.

In one preferred embodiment, the plastic blister includes a tray portion and a flange portion surrounding at least a portion of the tray portion. The flange portion is preferably heat sealed to the underlying paperboard substrate. In an embodiment where the flange portion completely surrounds the tray portion, the flange portion is heat sealed to the substantially paperboard substrate to isolate and enclose the pocket between the substantially paperboard substrate and the tray portion of the plastic blister.

In another preferred embodiment, the plastic blister further includes a pull tab for breaking the seal between the at least one plastic blister and the substantially paperboard substrate. At least a portion of the pull tab is preferably, initially unaffixed to the substantially paperboard substrate, to allow easier access by a consumer. The pull tab may also include a dimple to help separate at least a portion of the pull tab from the substrate surface.

In a preferred embodiment, the portion of the substantially paperboard substrate positioned adjacent the enclosed pocket is substantially entirely covered with the coating, to provide a moisture vapor barrier preferably protecting the entirety of the paperboard substrate adjacent the enclosed pocket from moisture penetration. In one preferred embodiment, the side of the substantially paperboard substrate attached to the plastic blister is completely covered with the coating. It is preferred that a product housed within the pocket is positionable directly adjacent at least one coated portion of the substantially paperboard substrate.

The blister package may further include a sleeve or other outer packaging for housing the plastic blister after it is heat sealed to the substantially paperboard substrate. In one embodiment, the sleeve includes a window for viewing the contents of the blister package.

The present invention is also directed to a process for attaching a plastic blister to a substantially paperboard substrate to create a blister package having an improved moisture vapor transmission barrier hindering penetration of moisture into the blister package from the surrounding environment. The process includes the steps of providing a substantially paperboard substrate having at least one surface; applying a coating to at least a portion of the substantially paperboard substrate to impart a moisture vapor transmission barrier to said substantially paperboard substrate to reduce transmission of moisture through said substantially paperboard substrate, while simultaneously imparting heat sealing capabilities to the coated portion of the substantially paperboard substrate to make the coated portion of the substantially paperboard substrate susceptible to a heat seal; and heat sealing a plastic blister over a coated portion of the substantially paperboard substrate to create an enclosed pocket isolated from the surrounding environment in which to house a product.

In an embodiment, the step of applying a coating to at least a portion of the surface of the substantially paperboard substrate includes applying the coating on a gravure press. In one embodiment, the coating is applied to the substantially paperboard substrate in a weight ratio ranging from approximately 0.75 lbs. dry weight coating/msf of the substantially paperboard substrate to approximately 1 lb. dry weight coating/msf of the substantially paperboard substrate.

Also in an embodiment, the process further includes the step of cutting an oversized sheet or web of substantially paperboard substrate material into a plurality of substrate units—after applying the coating. Those smaller substrate units may be reduced in size even further to useable card blanks by a blanker station.

The process preferably further includes the step of heating the substantially paperboard substrate after applying the coating to assist in curing the coating onto the substantially paperboard substrate. Further, the process also may include the step of actively cooling the substantially paperboard substrate after the step of heating the substantially paperboard substrate to assist in curing the coating onto the substantially paperboard substrate. Cooling may be accomplished by passing the coated substrate over a chill roller.

In a preferred embodiment, the process includes the step of inserting a product between at least a portion of the plastic blister and at least a portion of the substantially paperboard substrate before the step of heat sealing the plastic blister to the substantially paperboard substrate to affect enclosure of the at least one product in the pocket of the blister package. The product may be positioned inside the plastic blister before the plastic blister is heat sealed to the substantially paperboard substrate to accomplish this purpose.

BRIEF DESCRIPTION OF THE DRAWINGS

FIG. 1 is a front elevational view of a blister package according to the present invention;

FIG. 2 is a left side elevational view of the blister package shown in FIG. 1;

FIG. 3 is a perspective view of the blister package shown in FIG. 1;

FIG. 4 is a front elevational view of an aperatured sleeve for housing a blister package;

FIG. 5 is a rear elevational view of the sleeve shown in FIG. 4;

FIG. 6 is a side elevational view of the sleeve shown in FIG. 4;

FIG. 7 is a perspective view of the sleeve shown in FIG. 4;

DETAILED DESCRIPTION OF THE INVENTION

Figure 8:
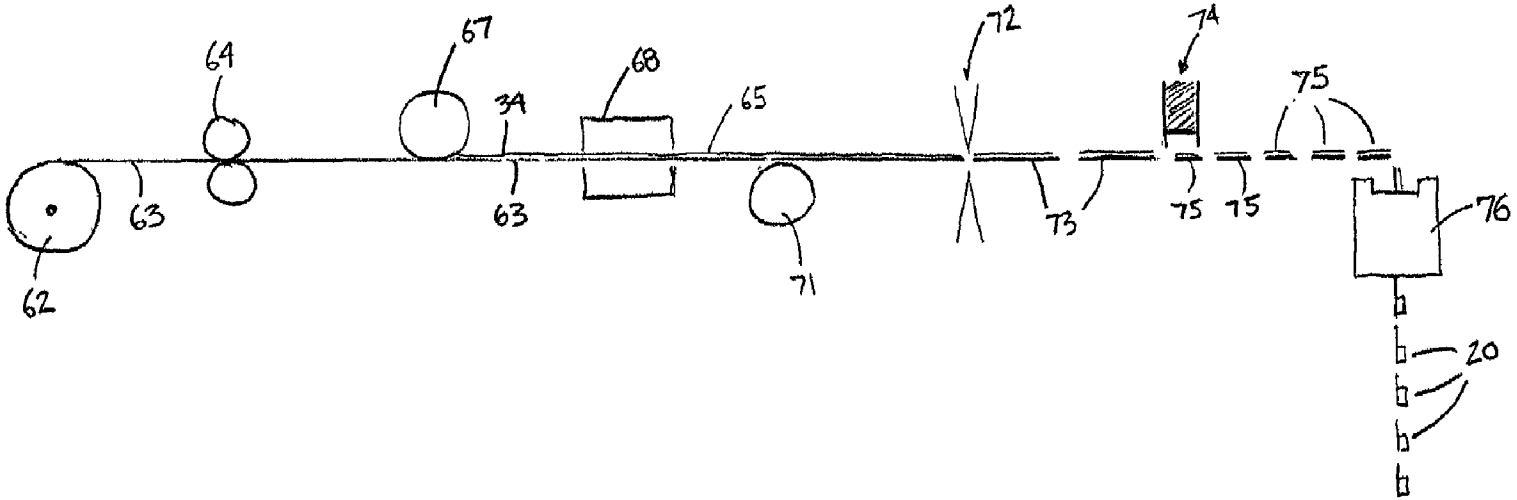
FIG. 8 is a schematic view of a process for heat sealing a plastic blister to a substantially paperboard substrate to create a blister package having an improved moisture vapor transmission barrier.

While this invention is susceptible of embodiment in many different forms, there are shown in the drawings, and will be described in detail, several specific embodiments with the understanding that the present disclosure is to be considered as an exemplification of the principals of the invention and is not intended to limit the invention to the embodiments illustrated.

Blister package 20 is shown in FIGS. 1–3 as comprising substantially paperboard card 22 and plastic blister 24. At the outset, it must be noted that while card 22 is shown as having a substantially square configuration, card 22 may take any desired configuration which may be used in conjunction with a given blister, which also may take any desired configuration. Further, while card 22 is shown in the drawings as a single, two-sided piece of paperboard, the card may comprise any substantially paperboard substrate taking any number of shapes, dimensions or sizes. Indeed, the substantially paperboard substrate may comprise an envelope, a box, or any other object which contains a substantially paperboard surface. Moreover, while card 22 will be described as having a substantially paperboard composition, it is likewise contemplated that card may include other materials or sections, as long as at least a portion of the card is fabricated from paperboard. Throughout this description and the drawings, like parts will be designated by like reference numerals.

Card 22 includes blister side 30, back side 32 and coating 34. Once again, those with ordinary skill in the art with the present disclosure before them will appreciate that card 22 is one of many possible substrates; however, the present invention will be described relative to the card shown. Coating 34 covers at least a portion of one side of card 22, and is shown as preferably covering the entirety of blister side 30. Complete coverage of the blister side of card 22 ensures that plastic blister 24 may be sealed to any portion of the card, in any desired orientation, without specifically aligning the plastic blister with a particular coated area. Further, complete coverage likewise ensures that the entirety of the blister pocket, described below, will be adjacent to and protected from infiltration of moisture vapor which penetrates through unprotected areas of card 22.

Of course, it is also contemplated that coating 34 may be applied only to select areas of card 22, limited to those specific contact areas beneath blister 24. However, coating 34 is preferably applied onto at least the entirety of card 22 proximate any portion of blister 24, to ensure that the improved moisture vapor transmission barrier properties hinder penetration of moisture into the pocket of the blister package, and to protect the contents of that pocket from the surrounding environment.

Coating 34 may comprise any coating which has moisture vapor transmission barrier properties, while simultaneously possessing heat seal capabilities such that blister 24 may be bonded to card 22 through a heat seal. In particular, vinylidene chloride polymer-based coatings have been found to be effective in facilitating a strong heat seal between card 22 and plastic blister 24, while substantially blocking moisture vapor transmission through the card. Such coatings may include a polyvinylidene chloride polymer, a polyvinylidene dichloride polymer, or co-polymer combinations thereof. Moreover, coating 34 may also include a wax component, such as paraffin wax. The wax component is believed to provide the coating with a non-stick property, to prevent the cards from sticking to one another during the manufacturing process. Notably, the wax component may not be needed in the coating formulation, depending on the blister package manufacturing process.

In one embodiment, the coating includes approximately 80%–95% by weight of a vinylidene chloride and/or vinylidene dichloride polymer component and approximately 3%–10% by weight of wax component. One such coating includes approximately 82.5%–87.5% by weight of a polyvinylidene dichloride/polyvinylidene chloride copolymer emulsion, approximately 3.0%–7.0% by weight paraffinic wax, approximately 5.0%–7.0% isopropyl alcohol and approximately 0.5%–1.0% by weight of a carboxylated amine. Suitable coatings are readily commercially available from a variety of sources, including Sun Chemical Corporation of Fort Lee, N.J. and Flint Ink Corporation of Ann Arbor, Mich.

Saran resin-based coatings manufactured by Dow Chemical Company are also contemplated for use with the present invention. The Saran coatings can also be mixed with a wax component. For example, the Saran component and the wax component may be mixed in a ratio of approximately 95 wt % Saran, and approximately 5 wt % of the wax component. An acceptable wax component is paraffinic wax.

Coating 34 is preferably applied to card 22 in a weight range of approximately 0.75 lbs. of dry weight coating/msf (thousand square feet of substrate) to approximately 1 lb. of dry weight coating/msf of substrate. Notably, while these weight ranges have been found to be suitable to coat card 22 shown and described, other weight ranges of the coating are likewise contemplated, depending on substrate thickness and construction. At this coating weight, coating 34 is typically less than a mil thick, although thickness may be varied according to the thickness of card 22 or other application surface.

Other coatings with a combination of moisture vapor transmission barrier properties and heat seal capabilities are likewise contemplated for use in the present invention as would be know by those with ordinary skill in the art with the present disclosure before them. Likewise, it is also contemplated that other films or substances outside of solvent-based or water-based coatings may be used to coat card 22. For instance, a low-density polyethylene film may impart heat seal capabilities, while also functioning as a moisture vapor barrier. In particular, molten low-density polyethylene may be applied, such as by polyextruding, onto the card or other paperboard substrate, as would be known by those with ordinary skill in the art with the present disclosure before them. Indeed, other films may also be used.

Plastic blister 24 is shown in FIGS. 1–3 as including tray portion 36, flange portion 38 and pull tab 40. Blister 24 is preferably made from a PVC plastic, thus rendering the blister clear. This allows a consumer to view a product contained in blister package 20 through clear blister 24. Flange portion 38 of blister 24 is heat sealed to card 22, thus forming a sealed ring around tray portion 36, which extends outward from flange portion 38 to provide an enclosed, impermeable pocket 43. Thus, as can be seen from FIG. 1, a continuous heat seal surrounds tray portion 36 of blister 24 to form pocket 43 between tray portion 36 of blister 24 and card 22. Preferably, the heat seal bond formed between blister 24 and card 22 may only be broken by actually tearing the fiber of card 22. This not only ensures impermeability of pocket 43, but also shows evidence of tampering with blister package 20.

Pull tab 40 is shown in FIGS. 1–3 as extending from flange portion 38 of blister 24. Pull tab 40 is not heat sealed to card 22, thus leaving at least a portion of pull tab 40 unattached to card 22 to allow a consumer to easily grasp blister 24 and tear the blister away from the card to access the contents of blister package 20. Moreover, pull tab 40 further includes dimple 42, which causes pull tab to stick up and extend from card 22, as shown in FIG. 2. This allows easier access to pull tab 40 for removal of blister 24 from card 22 to access the contents of pocket 43.

Inasmuch as plastic blister 24 is itself impermeable to moisture, and the heat seal between plastic blister 24 and card 22 is likewise impermeable to moisture, the only way for moisture to enter the interior of blister package 20 is through card 22. Coating 34, however, with its moisture vapor barrier properties, reduces the moisture vapor transmission rate through the card, and hinders moisture vapor transmission from the surrounding atmosphere through the card into pocket 43 of the blister package. This improved moisture vapor transmission barrier property is particularly critical when a product to be housed within blister package 20 is moisture sensitive. For instance, items such as gum, breath strips, foods or other moisture sensitive items may degrade when exposed to a certain amount of moisture, such as the moisture which may permeate through a paperboard backing card. Certain moisture sensitive items require housing in an enclosed environment which allows little or no penetration of moisture from the surrounding environment.

As is shown in FIGS. 4–7, blister package 20 may be used in combination with a sleeve, jacket or carrier, such as sleeve 26. In the particular embodiment shown in FIGS. 4–7, sleeve 26 includes front panel 44, back panel 46, top panel 48, bottom panel 50 and open sides 52 and 54. Blister package 20 may be slid into or out of sleeve 26 through either of open sides 52 and 54. Moreover, front panel 44 further includes aperture 56 for displaying the contents of blister package 20. However, it is likewise contemplated that blister package 20 may be used alone, or in combination with other sleeves, carriers or packages, as would be known by those of ordinary skill in the art with the present disclosure before them. Certainly, sleeve 26 is just one example of a multitude of packages which can be used in combination with blister package 20, or another blister package made in accordance with the principals of the present invention. Further, as shown in FIG. 1, blister 36 can include a raised flange formation at the top of the tray portion for precise capture, and fitment of the blister, within sleeve aperture 56. This, in turn, restrains the blister package within the sleeve.

Figure 9:
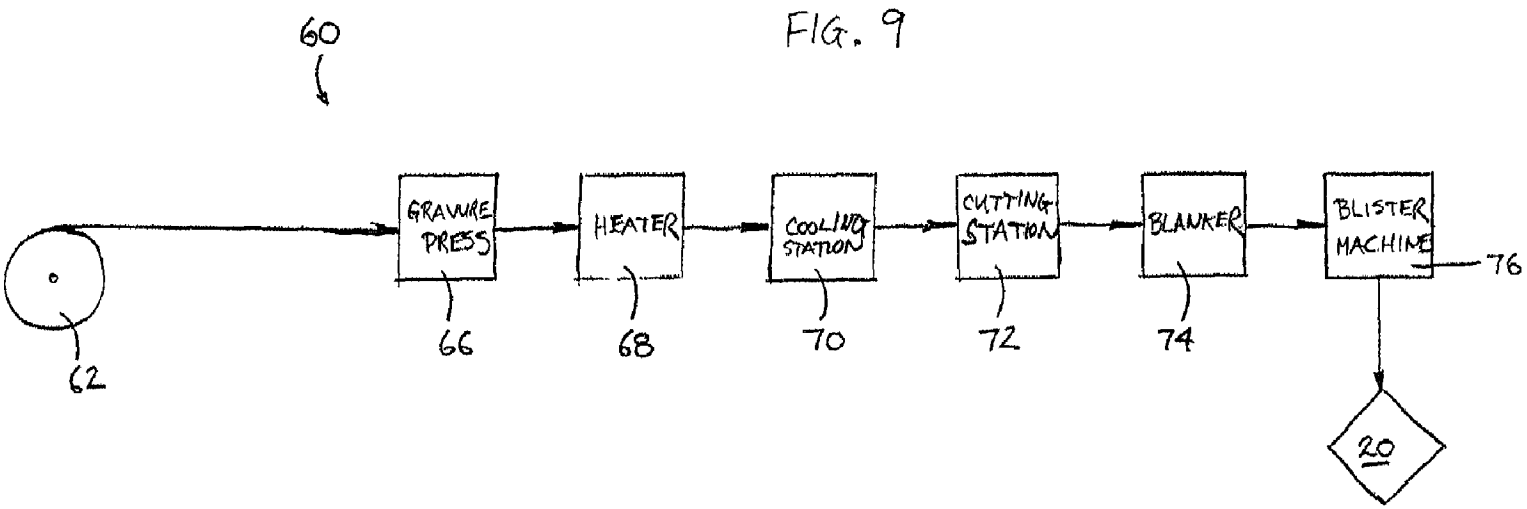
FIG. 9 is a block diagram schematic of the process shown in FIG. 8.

The present invention likewise includes a process for forming a heat sealed blister package having an improved moisture vapor transmission barrier which hinders penetration of moisture into the blister package from the surrounding environment. In particular, and is shown in FIGS. 8 and 9, process 60 begins with a roll of paperboard 62 having a desired thickness and composition. Paperboard roll 62 determines the ultimate thickness and composition of card 22.

Roll 62 is initially unwound such that a single flat web 63 of paperboard substrate first enters a gravure press 66. Gravure press 66 preferably includes at least one printing station 64 and at least one coating application station 67. While printing station 64 is shown in FIG. 8 in an exemplary manner as comprising a single station with one set of rollers, those with ordinary skill in the art with the present disclosure before them will recognize that any number of printing stations may be employed as may be required for a specific application. Any necessary printing onto web 63 is performed before the coating is applied. Notably, if printing onto web 63 is not required, printing station 64 may be excluded from process 60.

Upon exiting printing station 64 portion of gravure press 66, web 63 proceeds to coating station 67. Gravure press 66 preferably employs a rotogravure process to apply the coating, with an application cylinder that applies coating 34 onto web 63. Again, the single roller shown in FIG. 8 is merely exemplary of the rotogravure coating process, as would be know by those with ordinary skill in the art with the present disclosure before them. As was mentioned above, the application cylinder applies coating 34 in an approximate range of about 0.75 lbs. of dry weight coating/msf of substrate to approximately 1 lb. of dry weight coating/msf of substrate. The weight range of the coating can be important as a coating applied with too little weight may lead to difficulties with achieving a satisfactory heat seal between the web and the plastic blister later in the process. Likewise, a coating applied with too much weight can result in not only added material cost, but also a longer drying time. In particular, coating 34 is preferably a water-based coating; thus larger quantities of coating contain more water, and require a longer drying time. Of course, those with ordinary skill in the art with the present disclosure before them will appreciate that variations in the weight range of the coating applied by the gravure press may be necessary depending on the type of paperboard used.

After coating 34 is applied to web 63, coated web 65 is heated by heater 68. Heater 68 heats the surface of coated web 65 to evaporate the solvents in coating 34, to facilitate the process of curing the coating to the paperboard web. Heater 68 may take the form of a pass-through oven, although coated web 65 may be heated by other conventional heating mechanisms as would be known by those with ordinary skill in the art with the present disclosure before them.

From heater 68, the coated web 65 is passed to a cooling station 70, where coated web 65 is passed over chill roller 71. Chill roller 71 is preferably filled a refrigerant to facilitate completion of the coating curing process. Of course, cooling mechanisms other that a chill roller may be used to cool the coated web after removal of solvents from the coating in process 60, as would be known by those with ordinary skill in the art with the present disclosure before them.

Coated web 65 subsequently proceeds to cutting station 72, where coated web 65 is preferably cut into sheets 73. A blanker 74 preferably follows cutting station 72 to cut coated sheets 73 into specific coated cards 75 of a desirable size. Of course, it is also contemplated that coated web 65 may be cut into the desired card blanks directly by one machine or at one station. Moreover, it is likewise contemplated that the web may be cut into larger sheets before the coating press, depending on process equipment and specifications.

Finally, coated cards 75 are forwarded to blister machine 76. There, plastic blisters 24 are heat sealed to a targeted area of coated cards 75 to form blister packages 20. While the insertion of a product into the blister package can be accomplished in several ways, the product is preferably housed in blister 24 before heat sealing blister 24 to coated card 75. Specifically, the product is placed in tray portion 36 of plastic blister 24 before card 22 is positioned over blister 24 for heat sealing. However, any technique whereby the product to be included inside of blister package 20 is inserted between plastic blister 24 and card 22 before effecting a heat seal between the card and the plastic blister may be used, as would be known by those with ordinary skill in the art with the present disclosure before them.

The foregoing description and drawings merely explain and illustrate the invention, and the invention is not limited thereto except insofar as the appended claims are so limited as those skilled in the art having the present disclosure before them will be able to make modifications and variations therein without departing from the scope of the invention.

What is claimed is:

1. A heat seal blister package for an adversely moisture sensitive product, said blister package comprising:

a paperboard substrate having a blister side and a back side, said paperboard substrate configured to support the product thereupon;

a single coating applied to said blister side of said paperboard substrate to define a coated area, said coating including a carboxylated amine and having moisture vapor transmission baffler properties to reduce transmission of moisture through said paperboard substrate and having heat seal capabilities to make said coated area susceptible to a heat seal; and a plastic blister attached to said coated area of said paperboard substrate by a heat seal formed by said coating, said plastic blister and said coated area of said paperboard substrate cooperating to create an enclosed pocket, said enclosed pocket configured to house the product to prevent the product from being hydrated due to penetration of moisture through said paperboard substrate into said enclosed pocket from the surrounding environment.

2. The blister package according to claim 1 wherein said coating includes at least one component selected from the group consisting of a vinylidene chloride polymer, a vinylidene dichloride polymer and a vinylidene chloride/vinylidene dichloride copolymer emulsion.

3. The blister package according to claim 1 wherein said coating is predominant in at least one component selected from the group consisting of a vinylidene chloride polymer, a vinylidene dichloride polymer and a vinylidene chloride/vinylidene dichloride copolymer emulsion.

4. The blister package according to claim 1 wherein said coating further includes a wax component.

5. The blister package according to claim 4 wherein said coating includes approximately 95% by weight of a component selected from the group consisting of a vinylidene chloride polymer, a vinylidene dichloride polymer and a vinylidene chloride/vinylidene dichloride copolymer emulsion, and approximately 5% by weight of a wax component.

6. The blister package according to claim 1 wherein said coating includes approximately 80%–95% by weight of a vinylidene chloride/vinylidene dichloride copolymer emulsion and approximately 3%–10% by weight of a wax component.

7. The blister package according to claim 1 wherein said coating has a weight, as applied to said paperboard substrate, ranging from approximately 0.75 lbs. dry weight coating/msf of said paperboard substrate to approximately 1 lb. dry weight coating/msf of said paperboard substrate.

8. The blister package according to claim 1 wherein said heat seal created between said plastic blister and said paperboard substrate may be broken primarily by tearing fibers in said paperboard substrate.

9. The blister package according to claim 1 wherein said plastic blister includes a tray portion and a flange portion, said flange portion surrounding at least a portion of said tray portion, and said flange portion being heat sealed to said paperboard substrate to create said enclosed pocket between said paperboard substrate and said tray portion of said plastic blister.

10. The blister package according to claim 1 further including a sleeve for housing said paperboard substrate and said plastic blister.

11. The blister package according to claim 10 further including an aperture in said sleeve which substantially corresponds to the shape and orientation of said plastic blister.

12. The blister package according to claim 1 wherein said plastic blister further includes a pull tab for breaking said heat seal between said plastic blister and said paperboard substrate.

13. The blister package according to claim 12 wherein at least a portion of said pull tab is unaffixed to said paperboard substrate.

14. The blister package according to claim 1 wherein said enclosed pocket is adjacent to a portion of said blister side of said paperboard substrate, wherein the substantial entirety of said paperboard substrate positioned adjacent said enclosed pocket is covered with said coating.

15. The blister package according to claim 1 wherein said blister side of said paperboard substrate is completely covered with said coating.

16. The blister package according to claim 1 wherein the product housed within said enclosed pocket is positionable directly adjacent said coated area of said paperboard substrate.

17. The blister package according to claim 1 wherein said coating includes at least one component selected from the group consisting of a vinylidene chloride polymer, a vinylidene dichloride polymer and a vinylidene chloride/vinylidene dichloride copolymer emulsion, and said coating including a wax component and isopropyl alcohol.

18. The blister package according to claim 17 wherein said coating is predominant in at least one component selected from the group consisting of a vinylidene chloride polymer, a vinylidene dichloride polymer and a vinylidene chloride/vinylidene dichloride copolymer emulsion.

19. The blister package according to claim 17 wherein said coating includes approximately 80%–95% by weight of a vinylidene chloride/vinylidene dichloride copolymer emulsion, approximately 3%–10% by weight of a wax component, and approximately 5%–7% isopropyl alcohol.

20. The blister package according to claim 19 wherein said coating includes approximately 82.5%–87.5% by weight of a polyvinylidene dichloride/polyvinylidene chloride copolymer emulsion, and approximately 3.0%–7.0% by weight paraffinic wax, and said coating includes approximately 0.5%–1.0% by weight of a carboxylated amine.

21. A heat seal blister package for an adversely moisture sensitive product, said blister package comprising:

a paperboard substrate having a blister side and a back side, said paperboard substrate configured to support the product thereupon;

a single coating applied to said blister side of said paperboard substrate to define a coated area, said coating including approximately 82.5%–87.5% by weight of a polyvinylidene dichloride/polyvinylidene chloride copolymer emulsion, approximately 3.0%–7.0% by weight paraffinic wax, approximately 5.0%–7.0% isopropyl alcohol, and approximately 0.5%–1.0% by weight of a carboxylated amine, said coating having moisture vapor transmission barrier properties to reduce transmission of moisture through said paperboard substrate and having heat seal capabilities to make said coated area susceptible to a heat seal; and a plastic blister attached to said coated area of said paperboard substrate by a heat seal formed by said coating, said plastic blister and said coated area of said paperboard substrate cooperating to create an enclosed pocket, said enclosed pocket configured to house the product to prevent the product from being hydrated due to penetration of moisture through said paperboard substrate into said enclosed pocket from the surrounding environment.

22. A heat seal blister package for an adversely moisture sensitive product, said blister package comprising:

a paperboard substrate having a blister side and a back side, said paperboard substrate configured to support the product thereupon;

a single coating applied to said blister side of said paperboard substrate to define a coated area, said coating including a vinylidene chloride/vinylidene dichloride copolymer emulsion, a carboxylated amine, and a wax component, said coating having moisture vapor transmission baffler properties to reduce transmission of moisture through said paperboard substrate and having heat seal capabilities to make said coated area susceptible to a heat seal; and a plastic blister attached to said coated area of said paperboard substrate by a heat seal formed by said coating, said plastic blister and said coated area of said paperboard substrate cooperating to create an enclosed pocket, said enclosed pocket configured to house the product to prevent the product from being hydrated due to penetration of moisture through said paperboard substrate into said enclosed pocket from the surrounding environment.

23. The blister package according to claim 22 wherein said coating includes approximately 82.5%–87.5% by weight of a vinylidene chloride/vinylidene dichloride copolymer emulsion and approximately 3%–7% by weight of a wax component.

24. A heat seal blister package for an adversely moisture sensitive product, said blister package comprising:

a paperboard substrate having a blister side and a back side, said paperboard substrate configured to support the product thereupon;

a single coating applied to said blister side of said paperboard substrate to define a coated area, said coating including a vinylidene chloride/vinylidene dichloride copolymer emulsion, a wax component, isopropyl alcohol, and a carboxylated amine, said coating having moisture vapor transmission barrier properties to reduce transmission of moisture through said paperboard substrate and having heat seal capabilities to make said coated area susceptible to a heat seal; and a plastic blister attached to said coated area of said paperboard substrate by a heat seal formed by said coating, said plastic blister and said coated area of said paperboard substrate cooperating to create an enclosed pocket, said enclosed pocket configured to house the product to prevent the product from being hydrated due to penetration of moisture through said paperboard substrate into said enclosed pocket from the surrounding environment.

25. The blister package according to claim 24 wherein said coating includes approximately 82.5%–87.5% by weight of a vinylidene chloride/vinylidene dichloride copolymer emulsion, approximately 3%–7% by weight of a wax component, approximately 5%–7% isopropyl alcohol, and approximately 0.5%–1.0% by weight of a carboxylated amine.

* * * * *